US005381611A

United States Patent [19]

Tonel et al.

[11] Patent Number: 5,381,611

[45] Date of Patent: Jan. 17, 1995

[54] FOOTGEAR WITH REPLACEABLE FLAP ELEMENTS

[75] Inventors: Valerio Tonel, Biadene; Claudio Sartor, Zero Branco, both of Italy

[73] Assignee: Nordica S.p.A., Trevignano, Italy

[21] Appl. No.: 3,053

[22] Filed: Jan. 11, 1993

[30] Foreign Application Priority Data

Jan. 16, 1992 [IT] Italy ..... TV92 A 000003

[51] Int. Cl.[6] ..... A43B 5/04; A43B 11/00

[52] U.S. Cl. ..... 36/117; 36/50.5

[58] Field of Search ..... 36/50.5, 117, 118, 119, 36/120, 121

[56] References Cited

U.S. PATENT DOCUMENTS

| | | | |
|---|---|---|---|
| 3,956,796 | 5/1976 | Guolo | 36/50.5 X |
| 3,969,833 | 7/1976 | Vaccari | 36/117 |
| 4,090,278 | 5/1978 | Olivieri | 36/50.5 X |
| 4,510,703 | 4/1985 | Eiteljorg | 36/117 X |
| 4,638,578 | 1/1987 | Eiteljorg, II | 36/121 X |
| 4,841,650 | 6/1989 | Dodge et al. | 36/119 |
| 4,905,384 | 3/1990 | DeMarchi et al. | 36/117 |
| 4,914,839 | 4/1990 | Paris et al. | 36/120 X |
| 5,101,582 | 4/1992 | Pozzobon | 36/117 |
| 5,111,598 | 5/1992 | Sartor et al. | 36/117 |

FOREIGN PATENT DOCUMENTS

| | | | |
|---|---|---|---|
| 365428 | 1/1982 | Austria . | |
| 370296 | 3/1983 | Austria . | |
| 0134034 | 3/1985 | European Pat. Off. . | |
| 0252417 | 1/1988 | European Pat. Off. . | |
| 0484683 | 5/1992 | European Pat. Off. . | |
| 0484845 | 5/1992 | European Pat. Off. . | |
| 2043998 | 2/1971 | France . | |
| 2649594 | 1/1991 | France . | |
| 2607698 | 9/1977 | Germany | 36/120 |
| 3741601 | 6/1988 | Germany | 36/119 |
| 561031 | 4/1975 | Switzerland . | |

*Primary Examiner*—Paul T. Sewell
*Assistant Examiner*—BethAnne C. Cicconi
*Attorney, Agent, or Firm*—Guido Modiano; Albert Josif; Daniel O'Byrne

[57] ABSTRACT

A footgear, particularly usable for skiing, includes a shell which has a recess at the upper metatarsal region and with which at least one quarter is associated. One or more flaps are removably associable with the quarter and/or with the shell through connection members. The footgear thus obtained allows, by virtue of the interchangeability of the flaps, to replace them in case of breakage or wear, to vary the shape and color of the flaps and to recycle them once they have been changed.

6 Claims, 6 Drawing Sheets

FOOTGEAR WITH REPLACEABLE FLAP ELEMENTS

BACKGROUND OF THE INVENTION

The present invention relates to a footgear with replaceable flap elements, particularly but not exclusively usable for skiing.

Conventional ski boots are generally constituted by at least one quarter associated with a shell.

Both the shell and the quarter are usually manufactured by injecting thermoplastic material and are secured on the foot and on the leg by means of adapted tensioning devices for cables, straps or racks.

An important problem in designing the ski boots is that of optimally securing the foot inside the boot and at the same time achieving an optimum comfort for the skier.

German patent no. 2031751 filed on Jun. 26, 1970 discloses a shell having a region, located at the upper and lower metatarsal regions, which is open and can be closed by means of an adapted tongue provided with levers for securing it to the shell.

The shell also has, at the upper region of the malleoli, adapted notches suitable to allow a deformation of the upper quarter with respect to the shell.

This known type of boot, however, has a few problems. On one hand, the tongue and the shell are connected by means of hinges which create localized pressure points for the foot.

On the other hand, the tongue cannot be replaced easily when it is worn out, because this would require the drilling of the studs or rivets and subsequent connection, with centering problems. Furthermore, also the levers must be replaced because they are connected to the tongue, with a considerable increase in cost.

Another problem which in fact occurs in known ski boots is that some parts of the quarter are subject to wear during sports practice, and this makes the boot unaesthetic or unusable.

The rivets generally used to mutually connect elements made of plastic material, or the stitches employed when leather was used, make this replacement operation practically impossible, because of its high costs and also because of the fact that auxiliary devices, such as devices for varying the angle of the quarter with respect to the shell, are usually associated at the studs or guides for cables or other elements are located at said studs.

Italian patent no. 858508 filed on Feb. 26, 1969 discloses a ski boot manufacturing process wherein a rigid thermoplastic material is injected in a mold to form only the lower part of the item of footgear, which is joined to the upper part, made of another soft and semi-elastic material, by means of a melt-stitching with penetration of the materials along the joining line. Any replacement of the element made of soft material is unfeasible because of the high costs and also because of the possible deformation which the lower part, made of rigid thermoplastic material, may have undergone in the course of time.

Furthermore, any replacement would also entail the replacement of all the closure devices associated with the upper part made of soft material.

U.S. Pat. No. 3,609,887, filed on Mar. 18, 1970 discloses a process for manufacturing a ski boot entailing the production of a lower part and of an upper part which can be mutually joined at adapted coupling means.

However, said coupling means are very complicated, because a hinge-like articulation is provided laterally to the upper portion of two parts which constitute the quarter and for the connection of said articulation to an adapted plate which is laterally coupled to the lower part.

The boot thus obtained therefore has considerable problems from the point of view of comfort for the user, as well as aesthetic ones.

As a partial solution, Italian patent no. 162434, filed on Nov. 22, 1973 discloses a footgear, particularly for skiing, comprising a shell and a tongue which extends upward from the front part of the shell and up to the vicinity of the instep region and an intermediate collar element which embraces the median region of the sole of the shell. A longitudinal opening is formed at the tongue on the upper part of the intermediate element and an upper quarter is associated, by means of an articulation, with the intermediate element and with the shell. Closure means are provided on the intermediate element and on the upper quarter.

This boot, too, has a few problems. Any replacement of the intermediate element or of the upper quarter entails the need to unhinge them from the shell which, besides, during sports use, may have undergone deformations which might make watertightness ineffective during recoupling to a new intermediate element or upper quarter.

The cost of this replacement would also be high, due to the operations required to unhinge and recouple the elements.

This same Applicant also filed, on Oct. 13, 1976, an Italian Patent application, no. 28245 A/76, related to a ski boot comprising an upper quarter comprising a first part, which can overlap the shell at the front upper part of the foot, and a second part, which can be secured on the shell above the ankle. The first part is joined to the second part by means of linking portions provided at a pair of pivots protruding from the shell at the ankle.

However, this solution, too, has problems, because any replacement of the upper quarter entails treatment steps which provide for the uncoupling of said upper quarter from a protrusion or pin which protrudes from the shell, from the elastic membrane and from the pivots. Furthermore, this replacement would affect the entire structure of the upper quarter, and would thus have hardly negligible costs in relation to any small deformations or wear undergone in localized regions of said upper quarter.

A similar problem is also observed in the ski boot disclosed in U.S. Pat. No. 4,841,650, because the upper quarter is constituted by a single element associable with the shell.

The upper quarter furthermore interacts with several devices which might also require replacement in case of fatigue produced during sports practice.

Furthermore, the mentioned possibility of dividing the upper quarter into two parts entails, due to the considerable interaction between said parts during sports practice, the possibility of having to replace both parts, thus increasing costs for the operations.

Furthermore, the upper quarter and the shell are mutually connected at adapted protrusions which project from the lower perimetric edge of said upper quarter and are located at the adapted slots defined on the shell. These points are water infiltration regions and require, for correct waterproofing, a glueing which would thwart any replacement of the part.

SUMMARY OF THE INVENTION

One aim of the present invention is to eliminate the problems described above in known types by providing a footgear, particularly for skiing, which allows replacement due to wear or breakage of parts with very short intervention times and low costs.

Within the scope of this aim, an object of the invention is to provide a footgear wherein the replacement can be performed even directly by the user.

Another object is to provide a footgear wherein the user can perform a replacement in relation to a specific and localized breakage or wear.

Another object is to provide a footgear which also allows to achieve optimum comfort for the user's foot.

A further object is to provide a footgear which is structurally simple and has low manufacturing costs.

This aim, the objects mentioned and others which will become apparent hereinafter are achieved by a footgear, particularly for skiing, comprising at least one quarter associated with a shell, characterized in that at least one flap is removably associated with either one of said shell and said at least one quarter, at a recess, connection means being provided for removably associating said at least one flap with either one of said shell and said at least one quarter.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
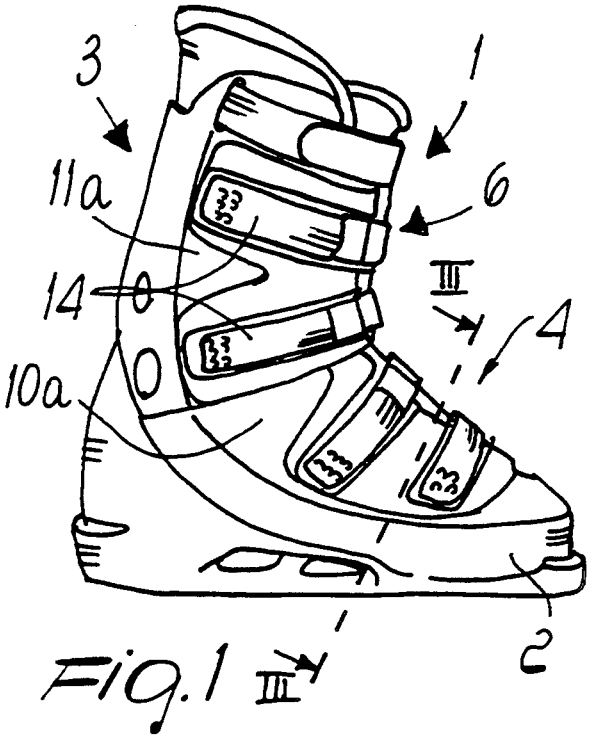
FIG. 1 is a side view of the footgear.
Figure 3:
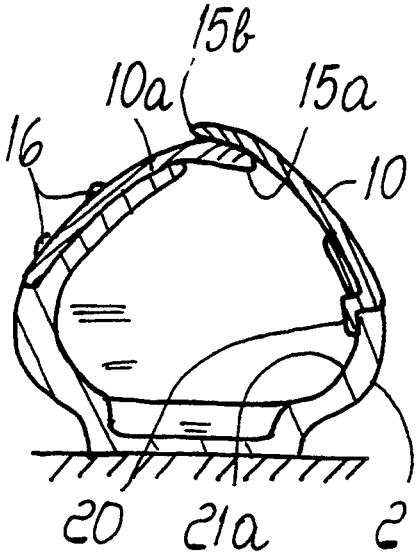
FIG. 3 is a sectional view, taken along the plane III—III of FIG. 1.
Figure 2:
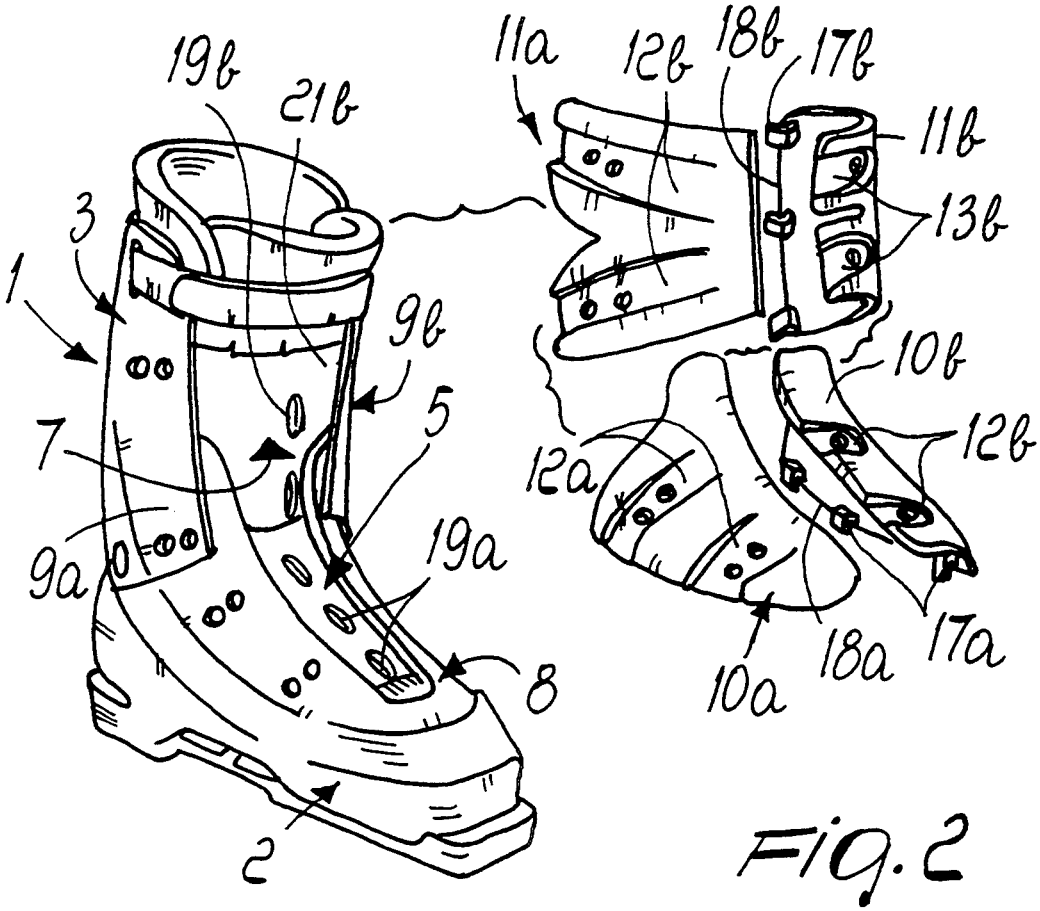
FIG. 2 is an exploded perspective view of the footgear.

With reference to FIGS. 1–5, the reference numeral 1 designates a ski boot comprising a shell 2 with which at least one quarter, designated by the reference numeral 3, is associated.

A longitudinal recess 5 is formed at the shell 2 at the upper metatarsal region 4.

The quarter 3 embraces the skier's leg at the rear side and has an opening 7 at the front region 6.

Adapted first and second seats, designated by the reference numerals 8 and **9*a*, 9*b*, for one or more flaps, are formed at the regions adjacent to the recess 5 and to the opening 7 which are formed on the shell 2 and on the quarter 3**. The flaps can be removably positioned in the seats.

In the particular solution shown in FIG. 1, a first pair of flaps **10*a* and 10*b*, are arranged at the first seat 8, and a second pair of flaps 11*a* and 11*b*, are arranged at the second seats 9*a* and 9*b***.

Both the first and the second pairs of flaps can of course be arranged at the respective first and second seats and have adapted first accommodation seats **12*a* and 12*b* and second accommodation seats 13*a* and 13*b* for adapted tensioning devices such as levers 14**.

The first and the second pairs of flaps also have a size suitable to allow the partial overlap of their free perimetric edges **15*a* and 15*b***.

Connection between the first pair of flaps and the shell and between the second pair of flaps and the quarter is provided by adapted rivets 16, so as to allow the simultaneous connection, for example, of the levers 14, or by means of the snap-together insertion of adapted tabs **17*a* and 17*b* which protrude from the perimetric edges 18*a* and 18*b*** of the first and second pairs of flaps.

Tabs **17*a* and 17*b* are substantially L-shaped, and are directed toward the inside of the shell 2. Tabs 17*a*, 17*b* can be inserted at adapted slots 19*a* and 19*b* formed respectively at the first seats 8 and at the second seats 9*a* and 9*b* defined on the shell 2 and on the quarter 3**.

The connection is very easy: it is sufficient to insert the wing 20 of the tabs **17*a* and 17*b* in the slots 19*a* and 19*b*, rotating the wing so that it arranges itself inside the shell or the quarter, adjacent to the inner lateral surface 21*a* and 21*b*** thereof.

Figure 4:
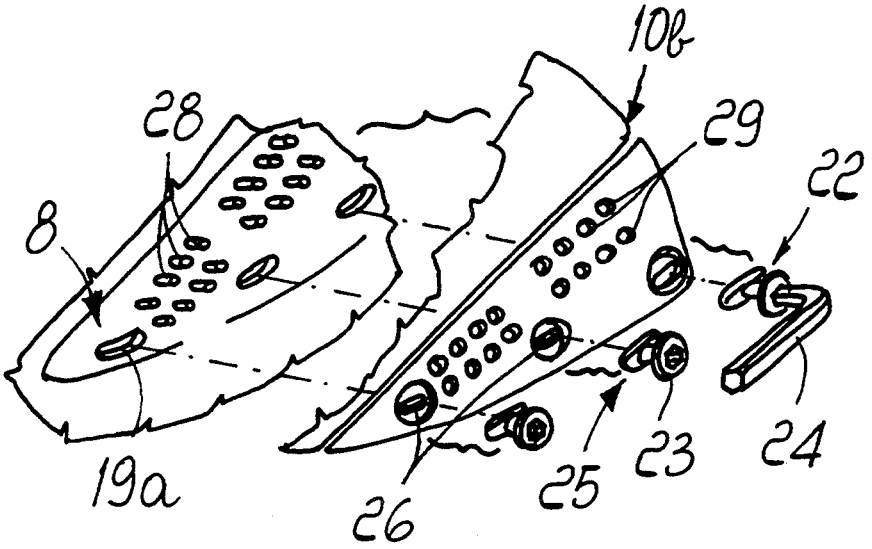
FIG. 4 is a detail view of the connection of a flap to the shell.

The connection between the first and/or second pair of flaps and the shell and/or the quarter may also be provided by removable fixing elements, as shown in FIG. 4, such as pins 22 having a head 23 which interacts with means such as an Allen wrench 24. Pins 22 also comprise a T-shaped stem 25 which can be inserted within a complementarily shaped slot 26 formed for example proximate to the perimetric edges **18*a* and 18*b*** of the flaps 10*b* and 11*b* and at the slots 19*a* and 19*b* formed on the first seats 8 and on the second seats 9*b* of the shell and of the quarter respectively.

Figure 5:
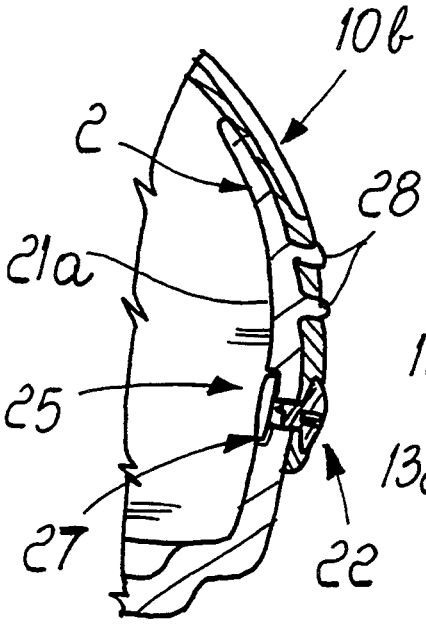
FIG. 5 is a sectional view, taken along a plane which is transverse to the shell and passes at the means for securing to the shell.
Figure 9:
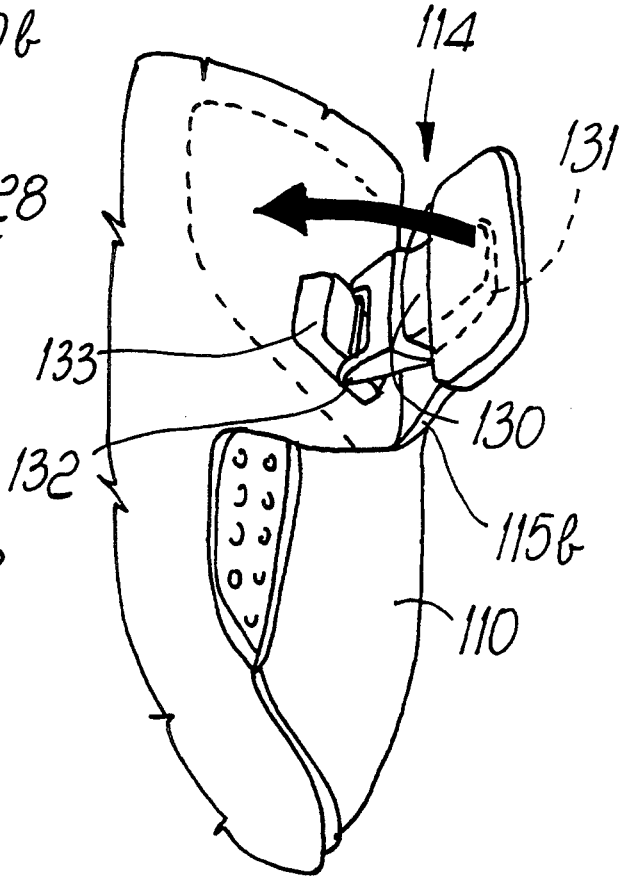
FIG. 9 is a detail view of a securing means.

As shown in FIG. 5, a rotation imparted to the pins 22 is matched by the arrangement of the free end of the stem 25 within a complementarily shaped third seat 27 which is arranged approximately at right angles to the axis of the respective slot 26 and of the slots 19*a* and 19*b* and is formed at the inner lateral surface 21*a* and 21*b* of the shell or of the quarter.

Advantageously, a plurality of lugs 28 protrudes toward the flap 10*b* at the first seat 8 defined on the shell 2. The lugs can be arranged within complementarily shaped holes 29 defined on said flap 10*b*.

The lugs allow, on one hand, to improve the removable connection of the flaps to the shell and, on the other hand, allow to aesthetically differentiate the boot.

It has thus been observed that the invention has achieved the intended aim and objects, a ski boot having been obtained wherein the user himself can remove and replace one or more of the flaps which constitute the first and second pair in a rapid and simple manner, for example if abrasions have formed on said flaps or if the levers have broken.

Thus, in addition to allowing selective replacement, the first and second pairs of flaps allow to ensure in any case optimum comfort for the user, optimum watertightness being ensured in any case because the flaps are coupled in regions which are not in close contact with the snow and in any case by virtue of means whose tightness is increased once the foot is inserted in the boot.

The user can thus also vary the material used for the first and second pairs of flaps, obtaining aesthetic changes for the boot and allowing the manufacturer to recycle the worn or broken flaps.

The footgear thus conceived is susceptible to numerous modifications and variations, all of which are within the scope of the same inventive concept.

Figure 6:
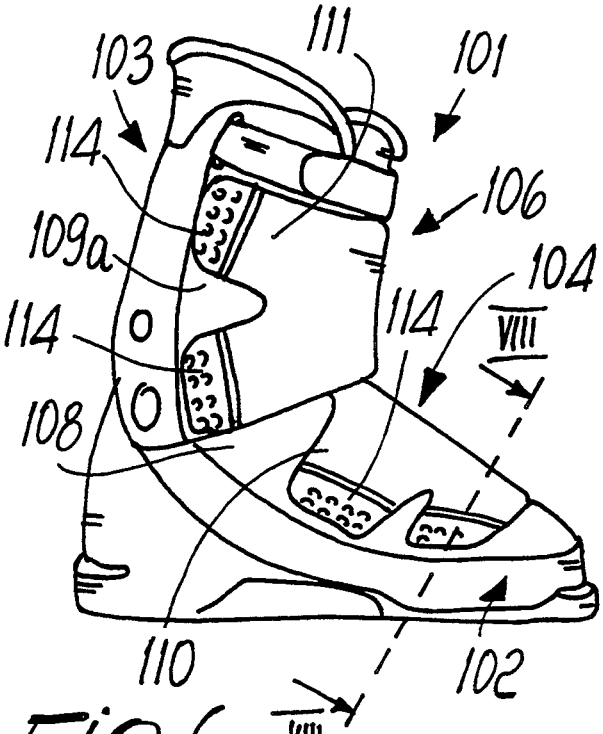
FIG. 6 is a view, similar to the one of FIG. 1, of a second embodiment.
Figure 8:
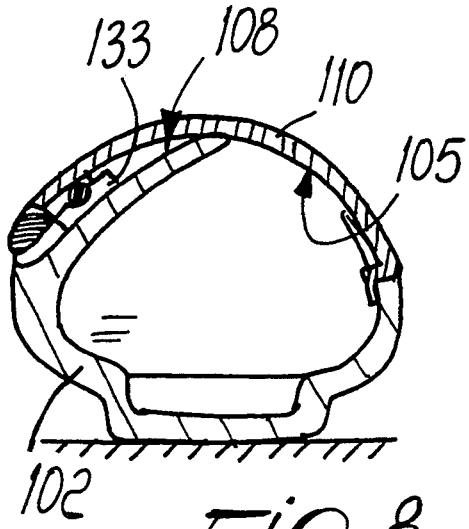
FIG. 8 is a sectional view, taken along the plane VIII—VIII of FIG. 6.
Figure 7:
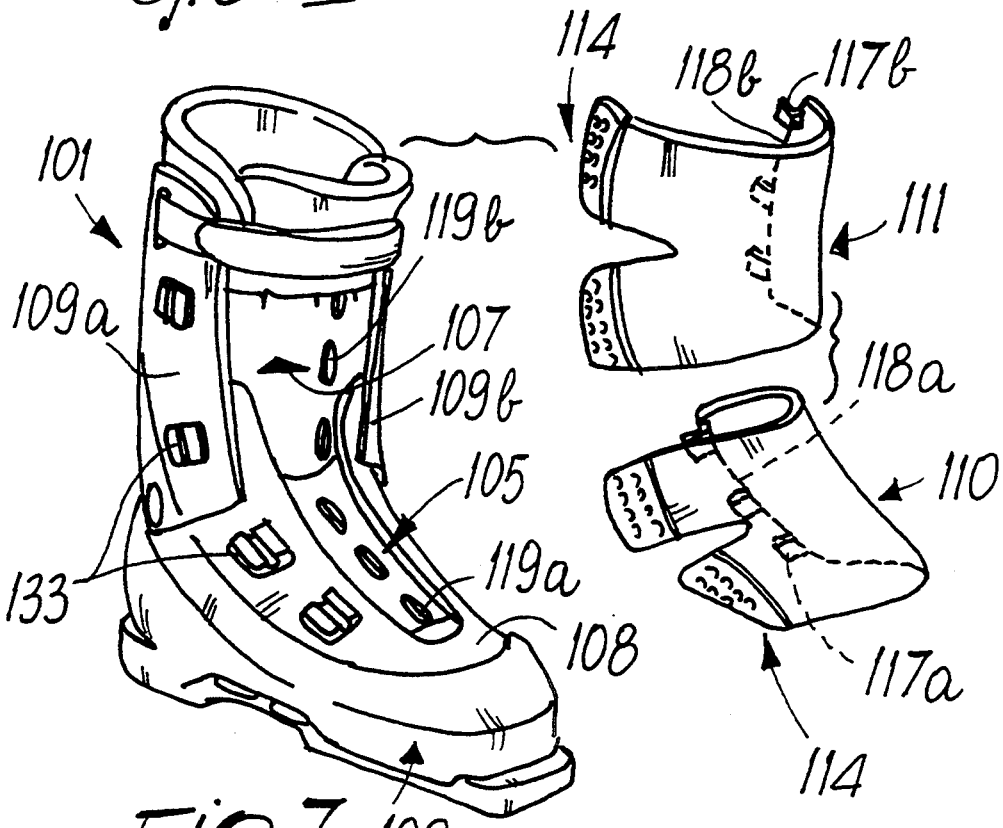
FIG. 7 is a view, similar to the one of FIG. 2, of the second embodiment.
Figure 10:
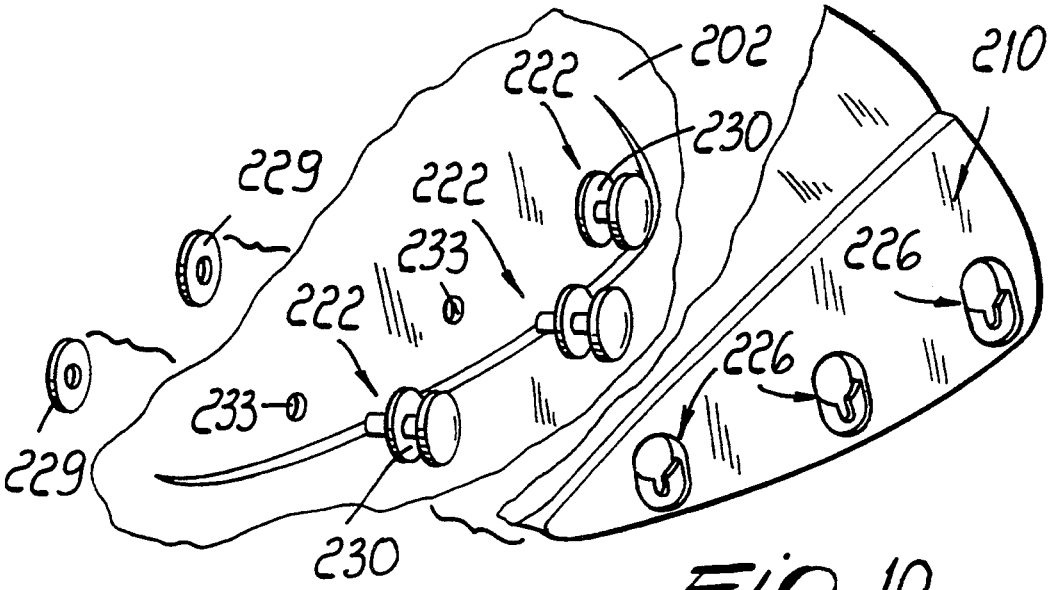
FIG. 10 is a perspective partial view of the connection means according to a third aspect of the invention.
Figure 11:
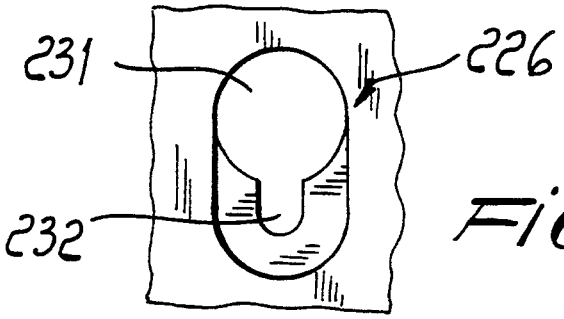
FIG. 11 is a front partial view of a seat of the connection means of FIG. 10.
Figure 12:
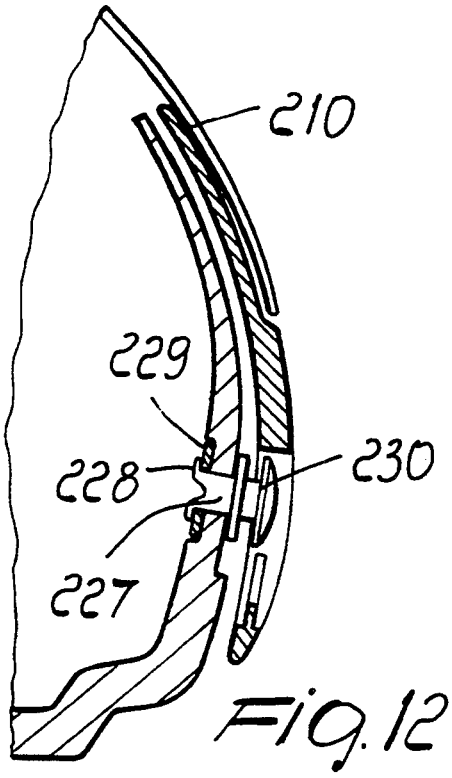
FIG. 12 is a partial front section view of the connection means of FIG. 10 shown in the act of engaging.
Figure 13:
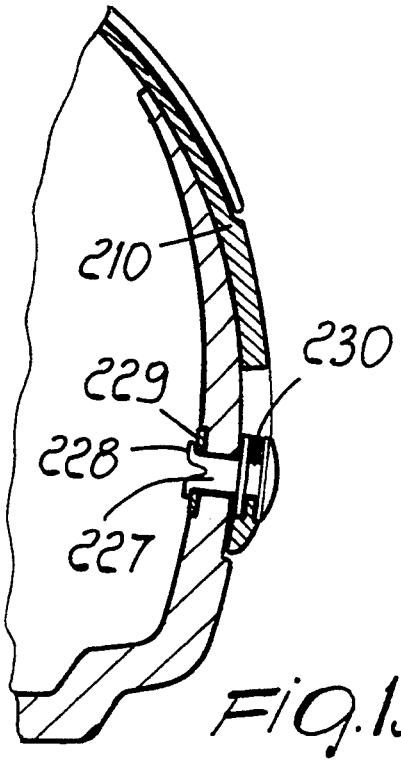
FIG. 13 is a partial front section view, similar to the preceding one, showing the connection means in the engaged position.
Figure 14:
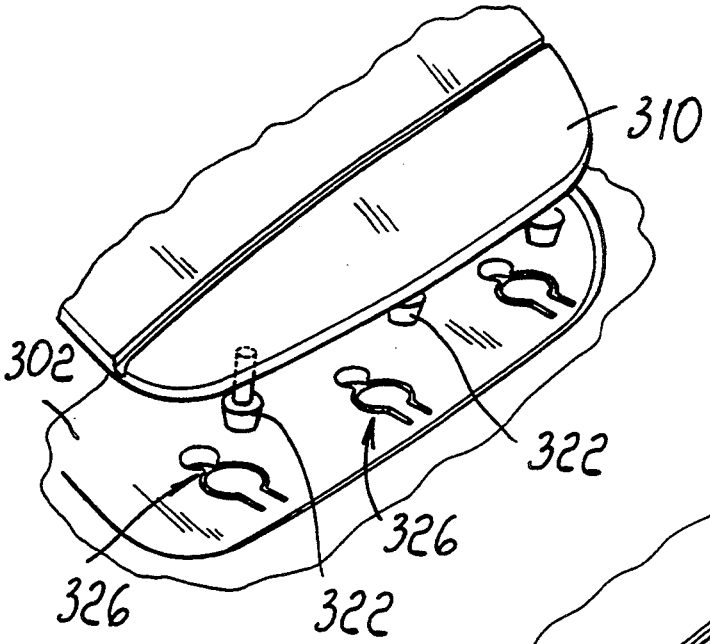
FIG. 14 is a perspective partial view of the connection means according to a fourth aspect of the invention, in the disengaged position.
Figure 15:
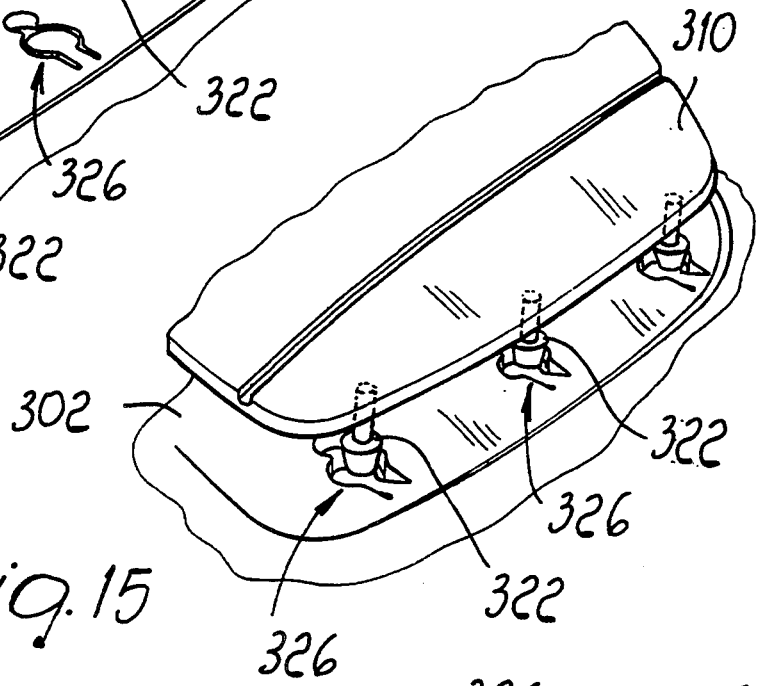
FIG. 15 is a view similar to the preceding one of the connection means in the act of engaging.
Figure 16:
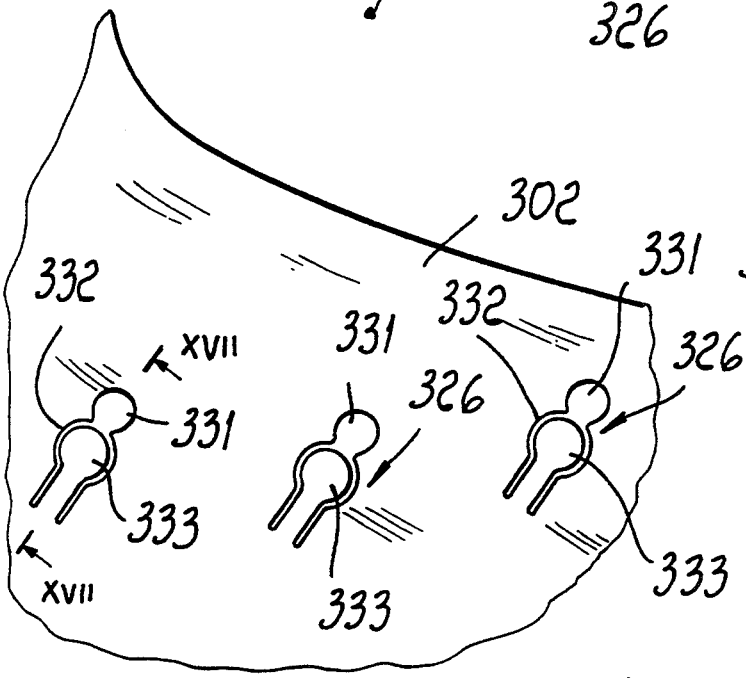
FIG. 16 is a front partial view of the connection means at the shell, according to the fourth aspect of the invention.
Figure 17:
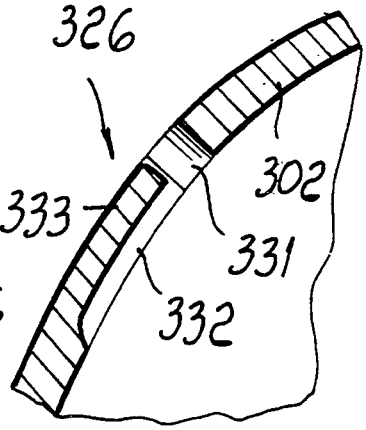
FIG. 17 is a section view according to line XVII—XVII of FIG. 16.
Figure 18:
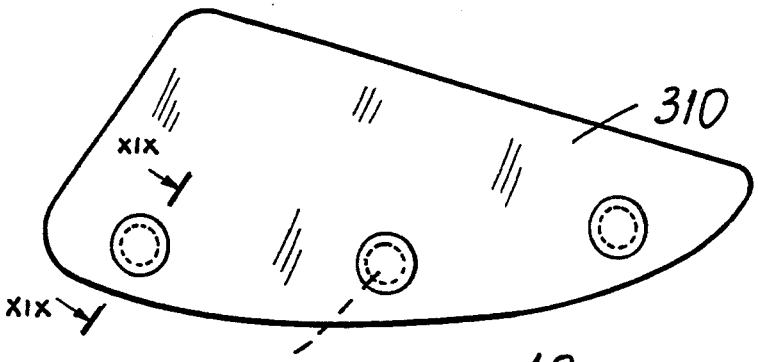
FIG. 18 is a front partial view of the connection means at the flap, according to the fourth aspect of the invention.
Figure 19:
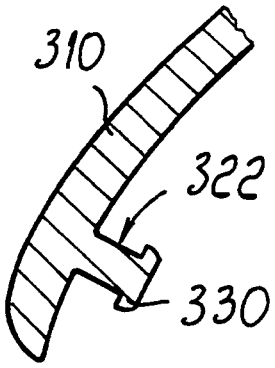
FIG. 19 is a section view according to line XIX—XIX of FIG. 18.

Thus, for example, FIGS. 6, 7 and 8 illustrate a boot 101, according to a second aspect of the invention, wherein a longitudinal recess 105 is formed at the shell 102 in the metatarsal region 104 and wherein an opening 107 is formed at the front region 106 of the quarter 103.

A first flap 110 and a second flap 111 are arranged at respective first seats 108 and second seats 109*a* and 109*b* which are formed proximate to the recess 105 and to the opening 107. First flap 110 and second flap 111 completely embrace the regions 104 and 106 and have, at their perimetric edges 118*a* and 118*b*, means for temporary engagement with the shell and with the quarter. The means for temporary engagement is constituted, for example, by a plurality of tabs 117*a* and 117*b*.

The tabs are substantially L-shaped and removably engage adapted slots 119*a* and 119*b* formed at the first seat 108 and at the second seat 109*b*.

Each one of the first and second flaps has, on the side opposite to said perimetric edges 118*a* and 118*b*, adapted seats for the first ends of adapted levers 114 which have a second end which interacts with adapted racks 133 associated at the second seat 109*a* and at the seat 108 on the side opposite to the slots 119*a*.

The levers are, for example, constituted by a central body 130 which has a first end 131 which can be retractably accommodated within an adapted seat. The seat is formed on the free perimetric edge which is opposite to the edge 118*a* or 118*b* of the flap 110 or 111. Central body 130 also has a second end 132 which temporarily engages at an adapted rack 133 which is externally associated with the shell or with the quarter.

FIGS. 10–13 illustrate a third embodiment of the invention wherein the connection means comprises a plurality of rivets 222 which can be associated with the shell 202 and are adapted to engage the holes 226 provided on the flap 210.

Each rivet 222 comprises a stem 227 having a split end 228 adapted to engage a ring 229. The rivet 222 has a head 230 provided with an annular groove, while each hole 226 comprise a substantially circular portion 231 connected to a slot portion 232.

Each rivet 222 is associated with shell 202 by inserting the stem 227 into a hole 233, provided on the shell, and by fastening the ring 229 at the split end 228 of the stem.

The flap 210 can be attached to the shell by simply inserting the heads 230 of rivets 222 into the circular portion 231 of the holes 226 and by sliding the flap in order to engage the annular groove of the heads 230 with the slot portion 232 of holes 226.

FIGS. 14–22 illustrate a fourth embodiment of the invention wherein the connection means comprises a plurality of rivets 322 formed on a covering flap 310 and adapted to engage respective holes 326 provided, for example, on the shell 302.

Rivets 322 are preferably integrally formed with the flap 310 and each comprises a head 330.

Each hole 326 comprises a smaller circular portion and a larger circular portion 332. The larger circular portion has a resilient tab 333.

The diameter of the head 330 is smaller than the larger circular portion 332 and is greater than the smaller circular portion 331.

Figure 20:
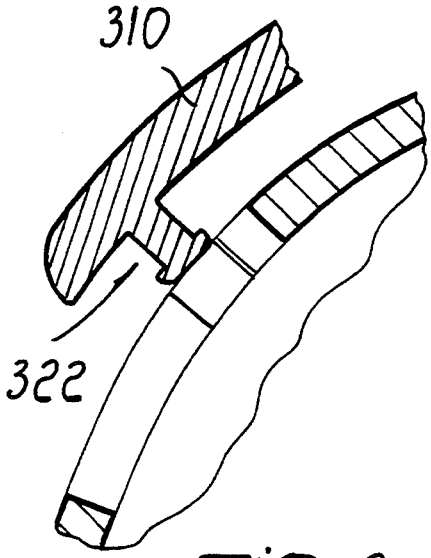
FIGS. 20–22 are side section detail views showing the connection means of FIGS. 14–15, respectively in the act of engaging, in the engaged position and in the locked position.
Figure 21:
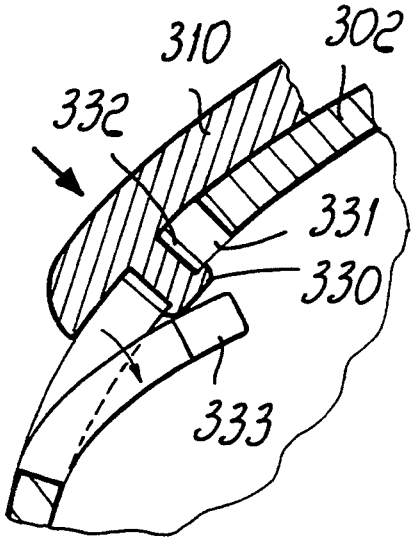
Figure 22:
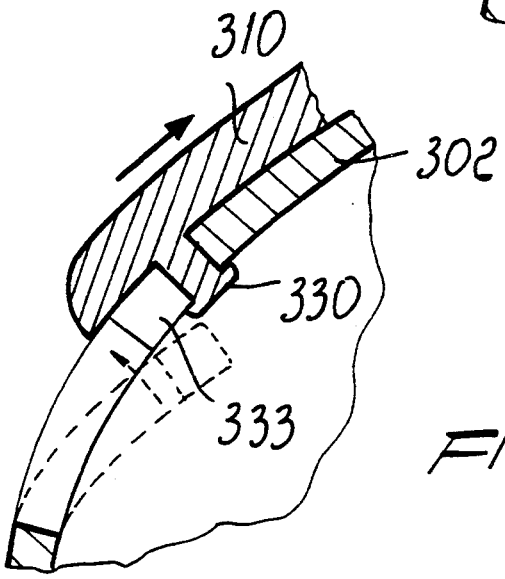

FIGS. 20–22 show the fastening operation of flap 310 to the shell 302. The head 330 of each rivet 322 is inserted into the larger circular portion 332 of holes 326, moving the resilient tab 333 as shown in FIG. 21. The rivet 322 is subsequently slid into the smaller circular portion 331 while the resilient tab 333 snaps back into the flattened position shown in solid lines in FIG. 22.

The materials and the dimensions which constitute the individual components of the footgear may be the most pertinent according to the specific requirements.

We claim:

1. Footgear comprising at least one quarter associated with a shell, wherein at least one flap is removably associated with either one of said shell and said at least one quarter at a recess thereof, the footgear further comprising connection means for removably connecting said at least one flap with either one of said shell and said at least one quarter, said connection means comprising a plurality of rivets associated with said shell or said at least one quarter for engaging in respective holes formed on said flap, each of said rivets comprising a stem having a split end adapted to engage a ring, each rivet also having a head provided with an annular groove, each of said holes comprising a substantially circular portion connected to a slot portion for engagement with said annular groove.

2. Footgear comprising at least one quarter associated with a shell, wherein at least one flap is removably associated with either one of said shell and said at least one quarter at a recess thereof, the footgear further comprising connection means for removably connecting said at least one flap with either one of said shell and said at least one quarter, said connection means comprising a plurality of rivets formed on said flap for engaging respective holes provided on said shell or on said at least one quarter, each of said rivets comprising a head, each of said holes comprising a smaller circular portion and a larger circular portion, said larger circular portion having a resilient tab, said head having a diameter smaller than said larger circular portion, said diameter being larger than said smaller circular portion.

3. Footgear comprising:

a shell, said shell having an upper metatarsal region, a longitudinal recess being formed in the shell at said upper metatarsal region;

at least one quarter connected to said shell, said quarter having a front region, an opening being formed in the quarter at said front region, said opening extending upwardly from the longitudinal recess of said shell;

at least one first flap element removably connected to said shell and arranged at said longitudinal recess;

at least one second flap element removably connected to said quarter and arranged at said opening; and connection means for removably connecting said at least one first flap element to said shell and for removably connecting said at least one second flap element to said quarter, the footgear comprising a pair of overlapping first flap elements and a pair of overlapping second flap elements.

4. Footgear comprising:

a shell, said shell having an upper metatarsal region, a longitudinal recess being formed in the shell at said upper metatarsal region;

at least one quarter connected to said shell, said quarter having a front region, an opening being formed in the quarter at said front region, said opening extending upwardly from the longitudinal recess of said shell;

at least one first flap element removably connected to said shell and arranged at said longitudinal recess;

at least one second flap element removably connected to said quarter and arranged at said opening; and connection means for removably connecting said at least one first flap element to said shell and for removably connecting said at least one second flap element to said quarter, wherein said connection means comprise L-shaped tabs protruding from said flap elements for removable engagement in slots provided on said shell and on said quarter.

5. Footgear comprising:

a shell, said shell having an upper metatarsal region, a longitudinal recess being formed in the shell at said upper metatarsal region;

at least one quarter connected to said shell, said quarter having a front region, an opening being formed in the quarter at said front region, said opening extending upwardly from the longitudinal recess of said shell;

at least one first flap element removably connected to said shell and arranged at said longitudinal recess;

at least one second flap element removably connected to said quarter and arranged at said opening; and connection means for removably connecting said at least one first flap element to said shell and for removably connecting said at least one second flap element to said quarter, wherein said connection means comprise a plurality of rivets associated with said shell or said at least one quarter for engaging in respective holes formed on said flap elements, each of said rivets comprising a stem having a split end adapted to engage a ring, each rivet also having a head provided with an annular groove, each of said holes comprising a substantially circular portion connected to a slot portion for engagement with said annular groove.

6. Footgear comprising:

a shell, said shell having an upper metatarsal region, a longitudinal recess being formed in the shell at said upper metatarsal region;

at least one quarter connected to said shell, said quarter having a front region, an opening being formed in the quarter at said front region, said opening extending upwardly from the longitudinal recess of said shell;

at least one first flap element removably connected to said shell and arranged at said longitudinal recess;

at least one second flap element removably connected to said quarter and arranged at said opening; and connection means for removably connecting said at least one first flap element to said shell and for removably connecting said at least one second flap element to said quarter, wherein said connection means comprise a plurality of rivets formed on said flap elements for engaging respective holes provided on said shell or on said at least one quarter, each of said rivets comprising a head, each of said holes comprising a smaller circular portion and a larger circular portion, said larger circular portion having a resilient tab, said head having a diameter smaller than said larger circular portion, said diameter being larger than said smaller circular portion.

* * * * *